US012409974B2

(12) United States Patent
Klaassen et al.

(10) Patent No.: US 12,409,974 B2
(45) Date of Patent: Sep. 9, 2025

(54) SPACER FOR STACKING OPEN CONTAINERS

(71) Applicant: Schoeller Allibert GmbH, Schwerin (DE)

(72) Inventors: Edwin Klaassen, Markelo (NL); Erik Brinkers, Zwolle (NL)

(73) Assignee: Schoeller Allibert GmbH, Schwerin (DE)

( * ) Notice: Subject to any disclaimer, the term of this patent is extended or adjusted under 35 U.S.C. 154(b) by 75 days.

(21) Appl. No.: 18/121,108

(22) Filed: Mar. 14, 2023

(65) Prior Publication Data

US 2023/0294875 A1 Sep. 21, 2023

(30) Foreign Application Priority Data

Mar. 15, 2022 (EP) ..... 22162143

(51) Int. Cl.
*B65D 21/02* (2006.01)
*B65D 25/24* (2006.01)

(52) U.S. Cl.
CPC ..... *B65D 21/0224* (2013.01)

(58) Field of Classification Search
CPC .... B65D 21/0224; B65D 85/62; B65D 71/04; B65D 81/127; B65D 2581/053;
(Continued)

(56) References Cited

U.S. PATENT DOCUMENTS 3,270,943 A 9/1966 Polenghi
3,944,073 A * 3/1976 Downing ..... B65D 21/0224 217/65

(Continued)

FOREIGN PATENT DOCUMENTS

AU 2010100594 * 7/2010 ..... B65D 21/0224
DE 2039269 A1 * 2/1972 ..... B65D 5/006

(Continued)

OTHER PUBLICATIONS

Search Report received in European Application No. 22162143.6-1014 dated Sep. 9, 2022, with translation, 9 pages.

*Primary Examiner* — Anthony D Stashick
*Assistant Examiner* — Marcos Javier Rodriguez Molina
(74) *Attorney, Agent, or Firm* — Christopher A. Rothe; CM Law

(57) ABSTRACT

A spacer for stacking first and second containers on each other. The spacer includes an elongated base body having a first support plate with a first support surface and a second support plate with a second support surface. Plunger portions project from the base body in opposite directions. The plunger portions are designed to plunge into respective recesses inside wall rims of the first and second containers stacked on top of each other or upside-down of each other. Fastening elements project from the base body to laterally enclose respective side walls of the first and second containers. The first and second support surfaces are designed to rest on the respective side wall rims of the first and second containers when the plunger portions plunge into the respective recesses of the first and second containers. The first and second support plates are spaced parallel from each other.

16 Claims, 5 Drawing Sheets

(58) Field of Classification Search

CPC .. B65D 81/054; B65D 2581/055; B65D 1/02; B65D 1/0215; B65D 1/20; B65D 1/22; B65D 1/225; B65D 1/265; B65D 1/32; B65D 1/34; B65D 1/42; B65D 1/48; B65D 11/10; B65D 11/1826; B65D 11/1833; B65D 11/1866; B65D 11/1873; B65D 11/188; B65D 11/22; B65D 11/24; B65D 17/00; B65D 17/02; B65D 19/0004; B65D 19/001; B65D 19/0018; B65D 19/0026; B65D 19/0028; B65D 19/0048; B65D 19/0053; B65D 19/0077; B65D 19/0095; B65D 19/0097; B65D 19/06; B65D 19/08; B65D 19/18; B65D 19/20; B65D 19/40; B65D 19/42; B65D 21/0201; B65D 21/0202; B65D 21/0209; B65D 21/0211; B65D 21/0212; B65D 21/0217; B65D 21/0219; B65D 21/0223; B65D 21/0226; B65D 21/0231; B65D 21/0233; B65D 21/041; B65D 21/045; B65D 21/046; B65D 21/064; B65D 21/066; B65D 21/068; B65D 21/086; B65D 2203/00; B65D 2203/02; B65D 2203/12; B65D 2205/00; B65D 2209/00; B65D 2215/02; B65D 2251/1083; B65D 23/102; B65D 23/10; B65D 2313/00; B65D 2401/00; B65D 25/005; B65D 25/02; B65D 25/101; B65D 25/103; B65D 25/14; B65D 25/16; B65D 25/24; B65D 25/28; B65D 25/52; B65D 25/525; B65D 25/0081; B65D 2501/24019; B65D 2501/24108; B65D 2501/24133; B65D 2501/24216; B65D 2501/24324; B65D 2501/24592; B65D 2501/24598; B65D 2501/0014; B65D 2517/0062; B65D 2519/00024; B65D 2519/00029; B65D 2519/00039; B65D 2519/00044; B65D 2519/00064; B65D 2519/00069; B65D 2519/00079; B65D 2519/00094; B65D 2519/00129; B65D 2519/00139; B65D 2519/00164; B65D 2519/00169; B65D 2519/00199; B65D 2519/00203; B65D 2519/00233; B65D 2519/00238; B65D 2519/00273; B65D 2519/00278; B65D 2519/00298; B65D 2519/00308; B65D 2519/00318; B65D 2519/00323; B65D 2519/00333; B65D 2519/00338; B65D 2519/00343; B65D 2519/00348; B65D 2519/00373; B65D 2519/00398; B65D 2519/00402; B65D 2519/00407; B65D 2519/00412; B65D 2519/00422; B65D 2519/00437; B65D 2519/00452; B65D 2519/00497; B65D 2519/00502; B65D 2519/00512; B65D 2519/00522; B65D 2519/00532; B65D 2519/00557; B65D 2519/00562; B65D 2519/00567; B65D 2519/00572; B65D 2519/00582; B65D 2519/00587; B65D 2519/00592; B65D 2519/00597; B65D 2519/00601; B65D 2519/00606; B65D 2519/00611; B65D 2519/00621; B65D 2519/00626; B65D 2519/00631; B65D 2519/00641; B65D 2519/00646; B65D 2519/00651; B65D 2519/00656; B65D 2519/00661; B65D 2519/00666; B65D 2519/00676; B65D 2519/00681; B65D 2519/00691; B65D 2519/00696; B65D 2519/00701; B65D 2519/00711; B65D 2519/00731; B65D 2519/00761; B65D 2519/00771; B65D 2519/00781; B65D 2519/00786; B65D 2519/00791; B65D 2519/00796; B65D 2519/008; B65D 2519/00805; B65D 2519/0081; B65D 2519/00815; B65D 2519/0082; B65D 2519/0084; B65D 2519/00855; B65D 2519/00875; B65D 2519/0088; B65D 2519/009; B65D 2519/00905; B65D 2519/0091; B65D 2519/00915; B65D 2519/00925; B65D 2519/0093; B65D 2519/0094; B65D 2519/00955; B65D 2519/0096; B65D 2519/00965; B65D 2519/0097; B65D 2519/00975; B65D 2519/00985; B65D 2519/0099; B65D 2519/00995; B65D 2543/00027; B65D 2543/00092; B65D 2543/00101; B65D 2543/00194; B65D 2543/0024; B65D 2543/00277; B65D 2543/00296; B65D 2543/00351; B65D 2543/00361; B65D 2543/00407; B65D 2543/00416; B65D 2543/00425; B65D 2543/00444; B65D 2543/00462; B65D 2543/0049; B65D 2543/00509; B65D 2543/00518; B65D 2543/00527; B65D 2543/00537; B65D 2543/00546; B65D 2543/00555; B65D 2543/00574; B65D 2543/0062; B65D 2543/00629; B65D 2543/00648; B65D 2543/00666; B65D 2543/00685; B65D 2543/00694; B65D 2543/00703; B65D 2543/00731; B65D 2543/0074; B65D 2543/00796; B65D 2543/00805; B65D 2543/00814; B65D 2543/00842; B65D 2543/00851; B65D 2543/00972; B65D 2571/00012; B65D 2571/00018; B65D 2571/00037; B65D 2571/00055; B65D 2571/00067; B65D 2571/00111; B65D 2571/00117; B65D 2571/00141; B65D 2571/0066; B65D 2571/00895; B65D 2581/02; B65D 2581/052; B65D 2581/056; B65D 2583/0481; B65D 2585/366; B65D 2585/649; B65D 2585/6867; B65D 2585/6877; B65D 2585/6882; B65D 2585/6887; B65D 2585/86; B65D 2585/88; B65D 2588/125; B65D 2590/0016; B65D 2590/0033; B65D 2590/005; B65D 2590/0066; B65D 2590/0091; B65D 3/22; B65D 31/12; B65D 33/00; B65D 33/001; B65D 33/004; B65D 33/007; B65D 33/065; B65D 33/08; B65D 33/14; B65D 33/2508; B65D 33/2584; B65D 39/00; B65D 41/04; B65D 43/02; B65D 43/0202; B65D 43/0206; B65D 43/0212; B65D 43/0218; B65D 43/022; B65D 43/0231; B65D 43/16; B65D 43/162; B65D 43/164; B65D 43/165; B65D 43/22; B65D 43/26; B65D 47/263; B65D 5/001; B65D 5/0015; B65D 5/0025; B65D 5/003; B65D 5/006; B65D 5/0065; B65D 5/0254; B65D 5/029; B65D 5/323;

B65D 5/42; B65D 5/4283; B65D 5/443; B65D 5/541; B65D 5/64; B65D 51/20; B65D 51/24; B65D 55/02; B65D 55/14; B65D 61/00; B65D 63/1009; B65D 7/045; B65D 7/06; B65D 7/08; B65D 7/28; B65D 7/30; B65D 7/32; B65D 71/0088; B65D 71/0096; B65D 71/70; B65D 75/14; B65D 75/527; B65D 75/58; B65D 77/04; B65D 77/0466; B65D 79/0084; B65D 79/0087; B65D 81/05; B65D 81/052; B65D 81/056; B65D 81/07; B65D 81/18; B65D 81/20; B65D 81/26; B65D 81/263; B65D 81/3813; B65D 83/00; B65D 83/0805; B65D 83/0811; B65D 83/0847; B65D 83/0894; B65D 83/10; B65D 83/20; B65D 85/24; B65D 85/30; B65D 85/34; B65D 85/36; B65D 85/46; B65D 85/48; B65D 85/544; B65D 85/68; B65D 85/70; B65D 88/005; B65D 88/022; B65D 88/123; B65D 88/126; B65D 88/30; B65D 88/52; B65D 88/528; B65D 88/54; B65D 9/12; B65D 9/24; B65D 9/32; B65D 9/0006; B65D 90/0013; B65D 90/002; B65D 90/004; B65D 90/0053; B65D 90/0073; B65D 90/008; B65D 90/02; B65D 90/046; B65D 90/08; B65D 90/12; B65D 90/205; B65D 90/24; B65D 1/0223; B65D 1/023; B65D 1/0276; B65D 1/243; B65D 1/26; B65D 1/36; B65D 1/38; B65D 1/40; B65D 11/14; B65D 11/16; B65D 11/18; B65D 11/1846; B65D 11/1853; B65D 11/1893; B65D 11/20; B65D 11/26; B65D 11/28; B65D 15/22; B65D 17/4011; B65D 17/4012; B65D 19/00; B65D 19/0012; B65D 19/0016; B65D 19/0036; B65D 19/004; B65D 19/0069; B65D 19/0073; B65D 19/02; B65D 19/04; B65D 19/10; B65D 19/12; B65D 19/16; B65D 19/36; B65D 19/38; B65D 19/385; B65D 19/44; B65D 21/00; B65D 21/02; B65D 21/0204; B65D 21/0205; B65D 21/0213; B65D 21/0215; B65D 21/0216; B65D 21/022; B65D 21/0222; B65D 21/0228; B65D 21/023; B65D 21/0234; B65D 21/0235; B65D 21/04; B65D 21/048; B65D 21/06; B65D 21/062; B65D 21/08; B65D 21/083; B65D 2203/04; B65D 2203/10; B65D 2205/02; B65D 2207/00; B65D 2251/0018; B65D 2251/0093; B65D 23/12; B65D 23/14; B65D 2301/10; B65D 2401/10; B65D 25/00; B65D 25/04; B65D 25/06; B65D 25/08; B65D 25/10; B65D 25/106; B65D 25/107; B65D 25/108; B65D 25/18; B65D 25/20; B65D 25/205; B65D 25/22; B65D 25/282; B65D 25/2835; B65D 25/2838; B65D 25/2841; B65D 25/2855; B65D 25/2858; B65D 25/2867; B65D 25/2873; B65D 25/2894; B65D 25/30; B65D 25/32; B65D 25/38; B65D 25/385; B65D 25/46; B65D 25/54; B65D 2501/0036; B65D 2501/0081; B65D 2501/2407; B65D 2501/24082; B65D 2501/24152; B65D 2501/2435; B65D 2501/24541; B65D 2501/24929; B65D 2517/0014; B65D 2517/0073; B65D 2519/00019; B65D 2519/00034; B65D 2519/00054; B65D 2519/00059; B65D 2519/00074; B65D 2519/00099; B65D 2519/00104; B65D 2519/00159; B65D 2519/00174; B65D 2519/00194; B65D 2519/00208; Y10S 229/918

USPC ..... 206/0.8, 0.81, 0.83, 0.84, 1.5, 1.7, 139, 206/145, 148, 150, 151, 158, 159, 162, 206/163, 165, 169, 203, 205, 210, 213.1, 206/214, 215, 216, 219, 221, 223, 225, 206/228, 229, 232, 233, 236, 256, 260, 206/274, 278, 284, 286, 3, 300, 303, 206/304.1, 305, 307, 307.1, 308.1, 308.3, 206/309, 310, 311, 312, 313, 315.1, 206/315.11, 318, 319, 321, 322, 323, 324, 206/326, 335, 337, 338, 343, 346, 347, 206/348, 349, 350, 354, 355, 356, 357, 206/360, 361, 362.3, 370, 372, 373, 379, 206/38, 380, 382, 383, 385, 386, 387.1, 206/387.11, 387.12, 387.15, 389, 39, 206/39.5, 39.6, 390, 391, 392, 394, 396, 206/403, 404, 408, 409, 416, 418, 419, 206/422, 423, 424, 425, 427, 428, 429, 206/432, 436, 438, 439, 440, 443, 445, 206/446, 448, 449, 45.2, 45.22, 45.27, 206/451, 452, 453, 454, 455, 456, 457, 206/458, 459.1, 459.5, 460, 467, 470, 206/472, 473, 478, 480, 482, 484, 485, 206/486, 488, 493, 494, 497, 499, 5.1, 206/501, 502, 503, 504, 505, 506, 507, 206/508, 509, 510, 511, 512, 513, 514, 206/515, 516, 517, 518, 519, 520, 521, 206/521.1, 521.5, 521.8, 522, 523, 524.1, 206/524.2, 524.6, 524.8, 525, 526, 527, 206/53, 534, 535, 537, 538, 541, 545, 206/546, 548, 549, 551, 554, 555, 556, 206/557, 558, 560, 561, 562, 563, 564, 206/565, 566, 568, 573, 574, 579, 581, 206/583, 585, 586, 587, 588, 589, 593, 206/594, 595, 596, 597, 598, 599, 6.1, 206/600, 63.3, 63.5, 70, 701, 703, 706, 206/708, 709, 710, 711, 712, 716, 718, 206/719, 722, 723, 724, 725, 726, 738, 206/739, 745, 749, 759, 761, 763, 769, 206/771, 776, 777, 784, 8, 804, 805, 806, 206/807, 812, 814, 817, 818, 819, 820, 206/821, 83.5, 831, 9, 81, 83, 84

See application file for complete search history.

(56) References Cited

U.S. PATENT DOCUMENTS

| | | | | |
|---|---|---|---|---|
| 4,293,072 | A | 10/1981 | Hill et al. | |
| 10,518,932 | B2 * | 12/2019 | Schwab | B65D 21/0224 |
| 2001/0008251 | A1 * | 7/2001 | Tsubaki | B65D 5/324 229/199 |
| 2006/0005875 | A1 * | 1/2006 | Haberlein | F24S 80/00 136/251 |

(56) References Cited

U.S. PATENT DOCUMENTS

| | | | | |
|---|---|---|---|---|
| 2006/0144607 | A1* | 7/2006 | Collins | B65D 25/2808 174/50 |
| 2014/0117014 | A1* | 5/2014 | Schwab | B65D 5/0065 220/23.83 |

FOREIGN PATENT DOCUMENTS

| | | | | | |
|---|---|---|---|---|---|
| DE | 2605557 | A1 | | 8/1977 | |
| DE | 2945372 | A1 | | 3/1981 | |
| DE | 8902828 | U1 | | 4/1989 | |
| EP | 0270343 | A1 | * | 6/1988 | B65D 5/006 |
| EP | 1886928 | A1 | * | 2/2008 | A47J 47/16 |
| EP | 2727854 | B1 | | 4/2016 | |
| GB | 2037709 | A | * | 7/1980 | B65D 21/0224 |
| GB | 2389842 | | * | 12/2003 | B65D 5/005 |
| NL | 1008541 | | * | 9/1999 | B65D 21/0224 |
| WO | 8603175 | A1 | | 6/1986 | |
| WO | WO-2005066028 | A1 | * | 7/2005 | B65D 11/1833 |

* cited by examiner

SPACER FOR STACKING OPEN CONTAINERS

CROSS-REFERENCE TO RELATED APPLICATION(S)

This application claims priority under 35 U.S.C. § 119 to European Application No. 22 162 143.6, filed Mar. 15, 2022, the content of which is incorporated by reference herein in its entirety.

FIELD

The present disclosure relates to a spacer or a stacking aid or fixing aid for stacking two containers on top of each other, in particular overhead or upside-down.

BACKGROUND

It is known to stack containers on top of each other for transport. This allows the containers to be arranged on a pallet, for example, and to be easily transported. It is furthermore known to use stacking aids in order to stack the containers in a fixed position. Known stacking aids grip around a side wall of a container and at the same time grip around a side wall of another container that is stacked on top of the container. Such stacking aids are positioned in particular at the corners of a container.

Such a stacking aid is disclosed in particular in EP 2 727 854 B1. The stacking aids are inserted in each case at the corners of a container and have two side walls spaced apart from each other, which enclose the side walls of the container. Then, an additional container can be placed on top of the stacking aids. The stacking aids also include the side walls of the additional container. In this way, the two containers are stacked on top of each other. Since these stacking aids merely rest on the side walls, they can easily bounce off the side walls or fall off the container. Furthermore, they can easily tilt together with the container stacked on top of them. This reduces the stability of the stacked containers.

DE 29 45 372 A1 describes an engagement hook that connects two containers stacked on top of each other and simultaneously spaces them apart. The engagement hook has latching lugs that engage in a groove on the underside or respectively the top side of the containers. Since the engagement hook only has a small support surface against the container compared to its longitudinal extension, the stack of containers stacked on top of each other with the engagement hook is unstable and may tilt when subjected to a lateral load.

DE 89 02 828 U1 shows bars which are attached to a container. The bars have holes/recesses into which spacers with pins are inserted. Here, too, the spacers do not rest at all or only minimally on the side walls of the containers. This results in unstable stacking and the risk of the entire stack tipping to one side.

SUMMARY

Thus, it is an object of the present disclosure to overcome the disadvantages of the prior art and to provide a stacking aid that allows stacking of multiple containers on top of each other in a manner that is as positionally stable as possible and secured against tipping. Furthermore, the multiple containers should be distanced from each other.

The present disclosure relates to a spacer (a stacking aid) for stacking identical first and second containers, wherein the second container is invertedly stacked on top of the first open container or, respectively, the second container turned upside-down and stacked on top of the first open container. The spacer has an elongated base body and at least two plunger portions. The plunger portions are prepared and configured to be plunged into a recess on a side wall rim or top edge of the container, respectively. The plunger portions each protrude outward from the elongated base body in opposite directions. The spacer also has (multiple) fastening elements, each of which protrudes from the base body at the rim in order to enclose a respective side wall of the container.

The elongated base body comprises a first support plate having a first support surface and a second support plate having a second support surface prepared and configured to rest on respective side wall rims of the containers. The second support plate is spaced parallel from the first support plate.

In other words, the spacer has an elongated plunger portion or, respectively, a plunger portion that spans a rectangle. The plunger portion is prepared and configured to be plunged into corresponding rectangular recesses of the containers on each side. A spacer portion extends transversely to the longitudinal direction of the plunger portion. The spacer portion has a first support surface which is prepared and configured to rest on the side wall rim of a first container. The spacer portion furthermore comprises a second support surface spaced parallel from the first support surface and also extending transversely to the longitudinal direction of the plunger portion. The second support surface is prepared and configured to rest on a side wall portion of a second container.

The first and the second support plate are both formed as elongated plates. The first support surface rests on the side wall rim of the first container, the second support surface rests on the side wall rim of the second container. Due to the elongated design, both support plates rest on a large surface area on the containers. The large support surface means a high degree of safety against slipping. The support plates preferably extend transversely/perpendicularly to the plunger portions.

So the core of the disclosure is that the spacer interacts with multiple elements/portions with the side wall of the containers. The plunger portions plunge into the recesses of the containers. The support surfaces lie flat against the side wall rim. The fastening elements enclose the side walls. The combination of the elements ensures on the one hand a stationary positioning of the spacer on the respective container and on the other hand safe stacking via the containers connected to the spacer (loosely and without tools), so that the stack of containers does not tip over or, respectively, the containers stacked on top of each other do not slip sideways and possibly fall off each other.

The support surface is preferably more than twice as large as an area of the plunger portions in a plan view. I.e. the support surface is preferably more than twice as large as an area of the recesses of the containers. Particularly preferably, the support surface is three times as large as the area of the plunger portions.

According to a further optional feature of the disclosure, the first support plate and the second support plate are connected by a connection portion. The connection portion thus spaces the two support surfaces apart from each other. Since the two support surfaces each abut a side wall rim of a container, the containers are also spaced apart.

Preferably, the connection portion is formed as a (thin) wall or rib extending vertically from the first support plate to the second support plate. Preferably, the connection portion is meander-shaped. The connection portion is formed as a thin wall so that the spacer can be manufactured by injection molding. It is of course conceivable to design the two (elongated) support surfaces and the connection portion between the support surfaces as an elongated cuboid base body. However, this would mean high material consumption and material accumulation, which is undesirable in particular for injection molding.

It is furthermore advantageous that the connection portion is offset, at least in sections, from a longitudinal axis of symmetry of the support surfaces. This results in an asymmetry of the spacer. Due to the asymmetry, the spacer has a higher torsional stiffness.

According to a further optional feature of the disclosure, the plunger portions protrude respectively from the first support plate and from the second support plate to a side of the support plates facing away from the connection portion. The plunger portions may protrude outward from the basic shape of the base body to be able to plunge into the recesses of the containers.

Preferably, the plunger portions extend transversely to the longitudinal direction of the base body. This means that the plunger portions protrude vertically from the two support plates in order to be able to plunge into the recesses of the containers.

According to a further optional feature of the disclosure, the plunger portions are each formed as a (thin) wall that meanders in a plan view. The recesses of the containers are approximately rectangular. Therefore, the basic shape of the plunger portions may also span a rectangle. Manufacturing the plunger portions as solid cuboids would mean high material consumption and unwanted material accumulation. Therefore, the plunger portions are each configured as a thin, meandering wall. Of course, other shapes of thin walls are conceivable as long as they have a rectangular ground plan. For example, it is conceivable to design the plunger portions as a grid of thin walls.

According to a further optional feature of the disclosure, a side wall of the spacer comprises a (horizontal) slit. The slit is positioned in a portion of the connection portion that closes the connection portion, thereby forming a side wall of the spacer. The slit has an opening, extends in a horizontal direction transverse to the longitudinal direction of the spacer, and converges in its direction of extension. A film for wrapping the stacked containers may be clamped in the slit. In particular, the beginning of the wrapping film is clamped into the slit. It is advantageous that when stacking the containers, at least one of the spacers is positioned on a container in such a way that the opening of the slit faces outward. This makes it easier for a user to clamp the beginning of the film into the slit.

According to a further optional feature of the disclosure, the connection portion in the region of the plunger portions is shaped/formed in the same way as the plunger portions. The plunger portions are symmetrically opposite each other with respect to the longitudinal axis of the spacer as an axis of symmetry. As a result, the plunger portions engage with the recesses of the containers, which are always present at defined positions on the containers. The recesses are present on the containers in order to be able to grip the containers automatically.

According to a further optional feature of the disclosure, the connection portion is connected to the first support plate and the second support plate by reinforcement ribs. This increases the stability of the spacer. The reinforcement ribs are easy to manufacture, for example by injection molding.

According to a further optional feature of the disclosure, the fastening elements each protrude from the support plates and are arranged obliquely opposite each other. The fastening elements are spaced from each other in the longitudinal extension of the first support plate. The fastening elements projecting from the second support plate are also spaced from each other in the longitudinal extension. The fastening elements of the two support plates are diagonally opposed to each other in order to counteract a rolling torque on the spacer arranged between two containers in both directions.

That is, in a plan view, the fastening elements protrude outward from a base surface of the support plates and additionally from the connection portion away from the support plates.

According to a further optional feature of the disclosure, the fastening elements and the plunger portions are arranged off-center with respect to the longitudinal extent of the base body. Preferably, the plunger portions are positioned in a different longitudinal half of the base body than the fastening elements. The plunger portions are located at one longitudinal end of the base body and the fastening elements at the other longitudinal end of the base body.

The fastening elements and the plunger portions are therefore positioned on opposite sides of the support plates. The plunger portions are attached to one end of the elongated support plates, and the fastening elements are attached to the other end. The plunger portions and the fastening elements are thus spaced apart. The support surfaces are located between the plunger portions and the fastening elements. Thus, the spacers interact with the side walls of the containers in three places. This results in high stability against tipping and lateral slipping of the spacers. The spaced plunger portions and fastening elements also prevent the spacers from twisting horizontally.

Preferably, the fastening elements are arranged diagonally offset with respect to the longitudinal axis of the spacer. This provides additional protection against twisting.

The present disclosure furthermore relates to a system comprising multiple spacers according to the preceding aspects and two identical containers. According to the disclosure, four spacers (according to the disclosure) each plunge with a plunger portion into the recesses/holes in the side wall portion of a first one of the two containers. The fastening elements of the spacers each enclose the side walls of the first container, and a second one of the two containers is placed inverted on the first container in such a way that the plunger portions of the spacers each plunge the recesses of the second container, and the fastening elements enclose the side walls of the second container. The spacers create a gap between the first container and the second container.

According to a further optional feature of the disclosure, a cross-section through the plunger portions or a plan view of the plunger portions is adapted to the shape of the recesses of the container. As a result, the plunger portions can plunge into the recesses and are seated in the recesses largely without play.

According to a further optional feature of the disclosure, a width of the first support surface and of the second support surface is the same as the thickness of the side walls of the container. As a result, the support surfaces lie as flat as possible against the side wall rims of the container.

According to a further optional feature of the disclosure, a distance in a direction transverse to the longitudinal direction of the base body between the fastening elements is as great as the thickness of the side walls of the container. This allows the fastening elements to enclose the side walls.

BRIEF DESCRIPTION OF THE DRAWING FIGURES

DETAILED DESCRIPTION

Figure 1:
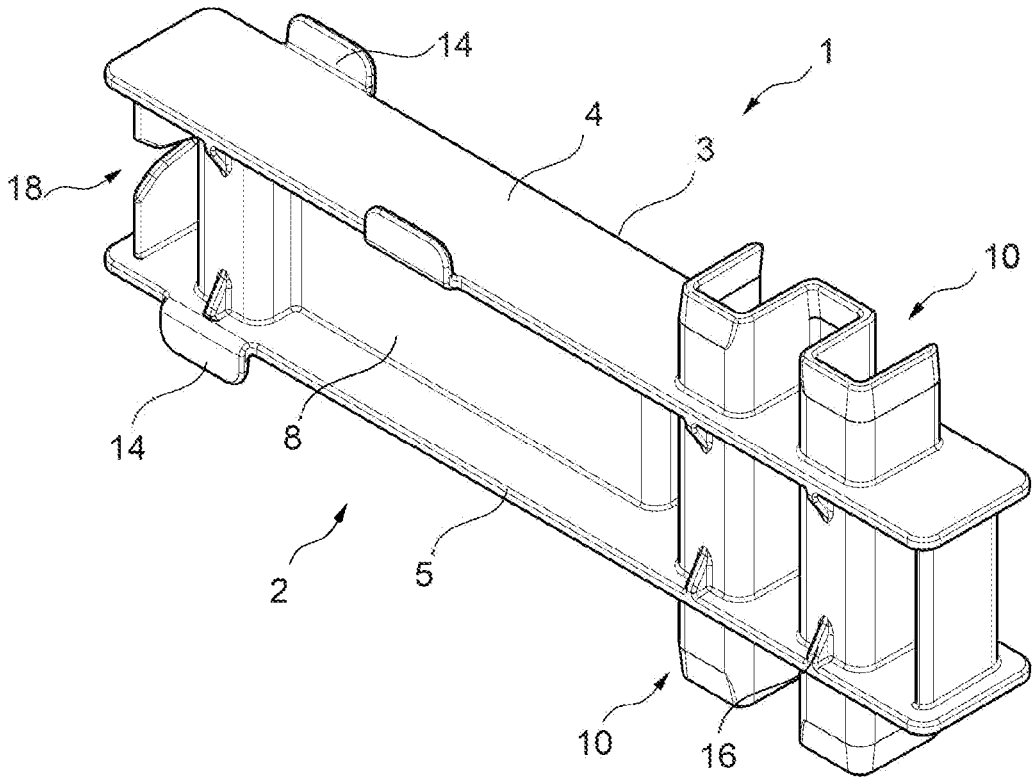
FIG. 1 shows an isometric illustration of a spacer according to the disclosure.
Figure 8:
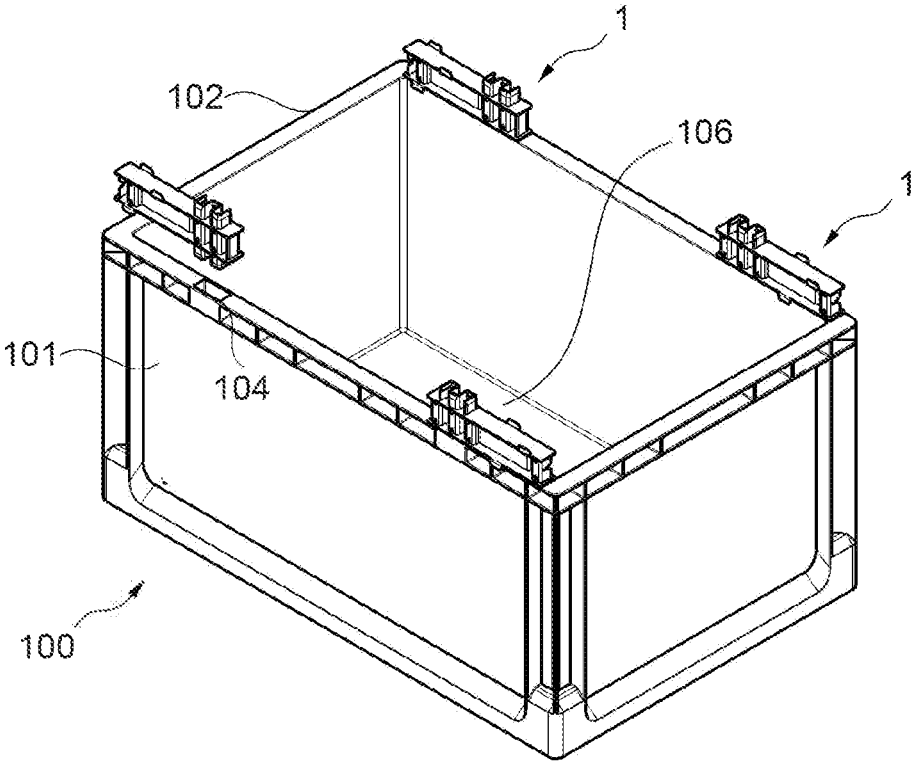
FIG. 8 shows the container with four spacers according to the disclosure.

FIG. 1 shows an isometric illustration of a spacer 1 for placement on a container 100, more precisely on an upper rim or a side wall rim 102 of the container 100 (cf. FIG. 8). The spacer 1 has an elongated base body 2. The elongated base body 2 has a first elongated, rectangular support plate 3 with a first support surface 4 and spaced parallel thereto, a second elongated, rectangular support plate 5 with a second support surface 6. The first support plate 3 and the second support plate 5 are each connected by a connection portion 8. The connection portion 8 is a thin wall or rib extending perpendicular to and between the two support plates 3 and 5 and is meander-shaped. Slanted reinforcement ribs 16 are provided at several points between the connection portion 8 and the first support plate 3 on the one hand and the second support plate 5 on the other hand.

Figure 5:
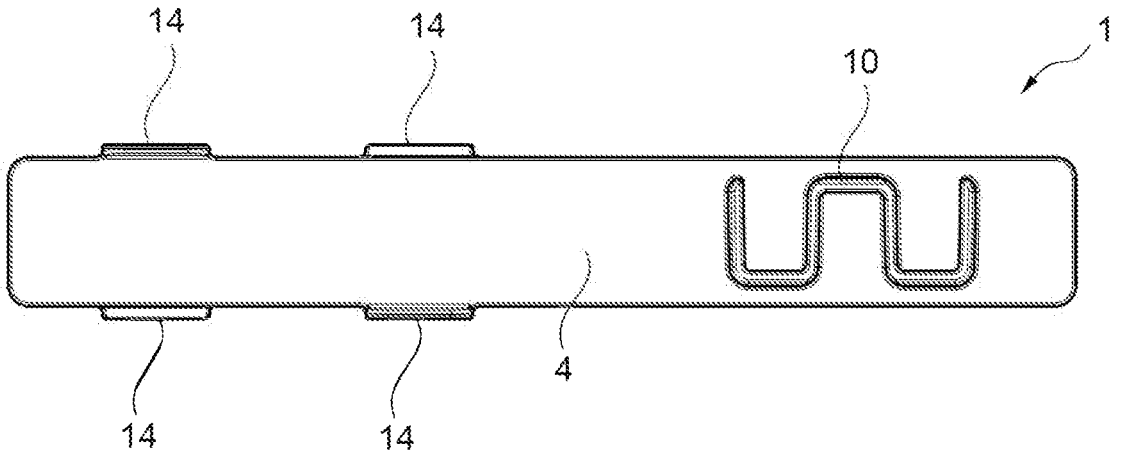
FIG. 5 shows a top view of the spacer according to the disclosure.

Respective plunger portions 10 protrude from the first support surface 4 and the second support surface 6 perpendicularly to them and in opposite directions. The two plunger portions 10 are each formed as a thin wall perpendicular to the support surfaces 4 and 6. In a plan view, the thin wall has a meandering shape that spans a rectangle, as shown in FIG. 5. In the area of the two plunger portions 10, the connection portion 8 between the two support plates 3 and 5 has the same shape as the plunger portions 10.

On opposite rims of the support plates 3 and 5, retainer ribs projecting vertically and in the same directions as the plunger portions 10 are provided, which serve as fastening elements 14 to enclose or hold between them the upper rim or side wall rim 102 of the container from two opposite sides. The fastening elements 14, which protrude from the first support plate 3, are arranged diagonally opposite each other or respectively spaced apart in the longitudinal extension of the first support plate 3. The same applies to the fastening elements 14 projecting from the second support plate 5, wherein the fastening elements 14 of the two support plates 3 and 5 are diagonally opposite each other in order to counteract a rolling torque on the spacer 1 arranged between two containers 100 and 200 in both directions.

With respect to the longitudinal extension of the base body, both the plunger portions 10 and the fastening elements 14 are arranged off-center, i.e. the plunger portions 10 are located on one longitudinal half of the base body 2 and the fastening portions 14 are located on the other longitudinal half of the base body 2 or at one longitudinal end and at the other longitudinal end of the base body 2, respectively.

The first support surface 4 and the second support surface 6 are prepared and configured to rest on a side wall rim 102 of a side wall 101 of the container 100. The plunger portions 10 are shaped to fit into a rectangular recess 104 in the side wall rim 102 of the container 100. The formation of the plunger portions 10 as a thin wall is due to the production by injection molding. Accordingly, it is conceivable that the plunger portions 10 have a different shape. The fastening elements 14 protrude laterally from a plan view of the support surfaces 4, 6. The fastening elements 14 are arranged in such a way that they enclose the side wall 101 of the container 100.

Figure 2:
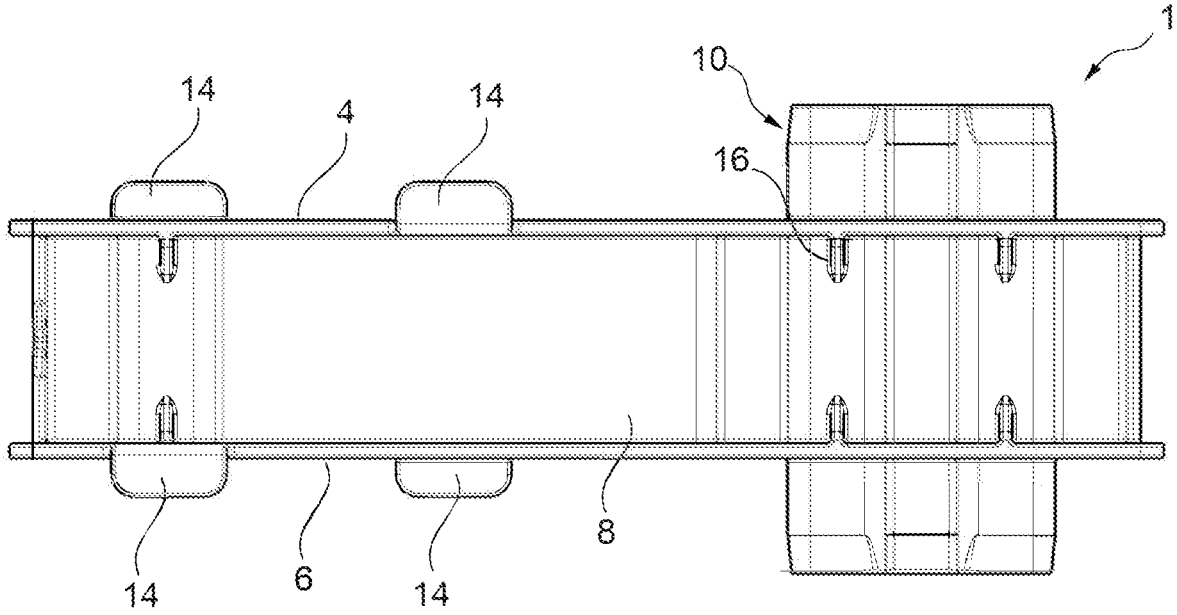
FIG. 2 shows a front view of the spacer according to the disclosure.

FIG. 2 shows a front view of the spacer 1. It is shown that the plunger portions 10 and the fastening elements 14 protrude outward from the first support plate 3 and the second support plate 5. The reinforcement ribs 16 respectively connect the first support plate 3 and the second support plate 5 to the connection portion 8.

Figure 3:
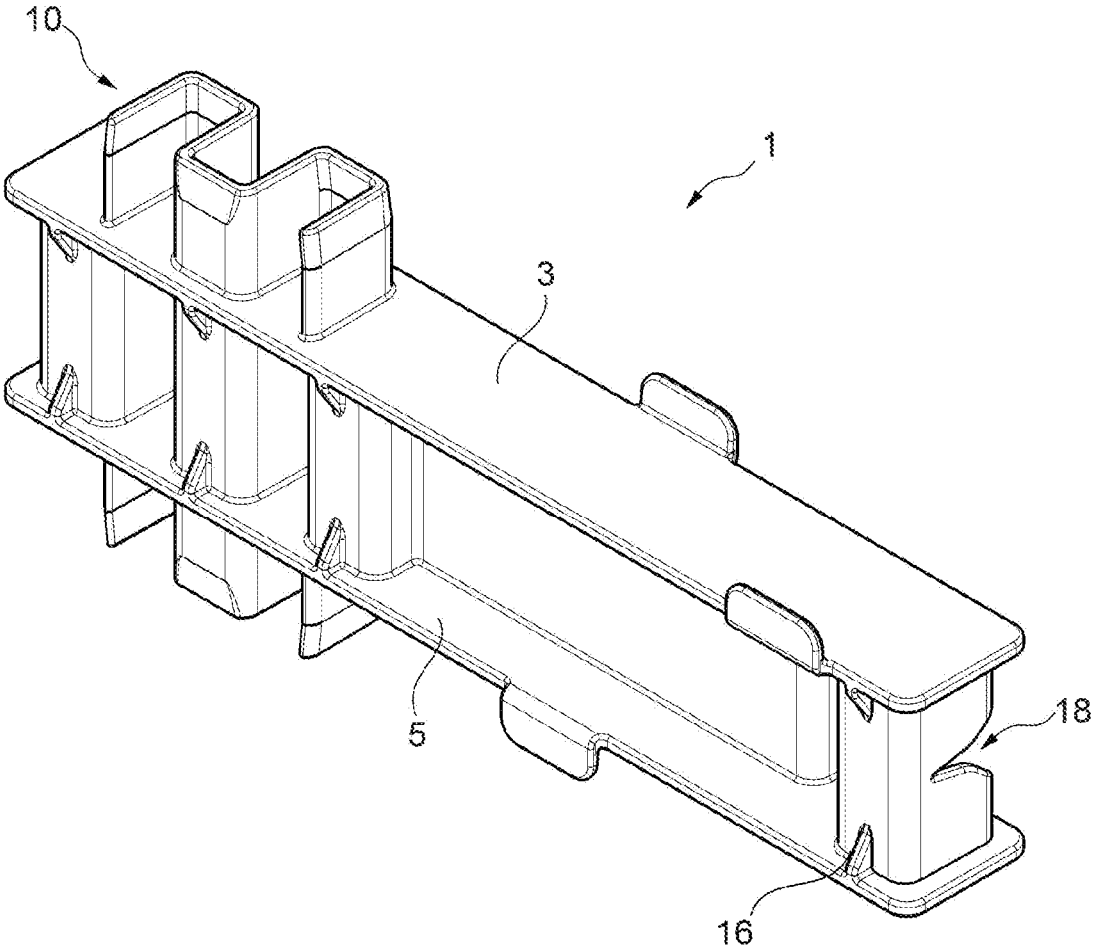
FIG. 3 shows a further isometric illustration of the spacer according to the disclosure.
Figure 4:
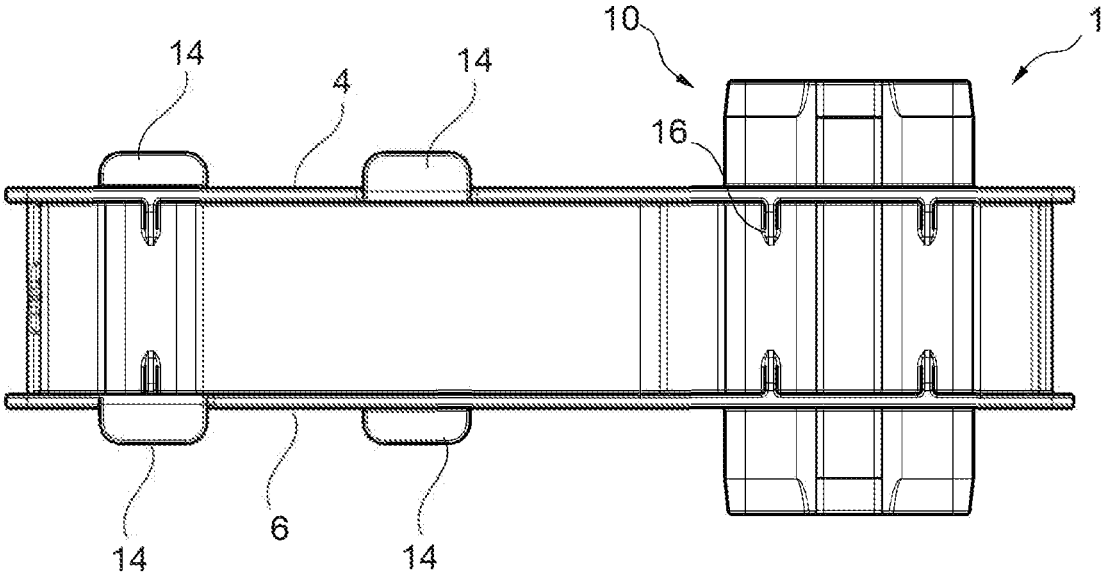
FIG. 4 shows a rear view of the spacer according to the disclosure.

FIG. 3 shows an isometric illustration of a rear side of the spacer 1. A rear view of the spacer 1 is shown in FIG. 4. Here, too, the first support plate 3 and the second support plate 5 are each connected to the connection portion 8 via the reinforcement ribs 16.

FIG. 5 shows a top view of the spacer 1 and the first support plate 5. The meandering shape of the plunger portion 10 is shown. It is also clear that the fastening elements 14 each protrude laterally from a plan view of the two support plates 3, 5.

Figure 6:
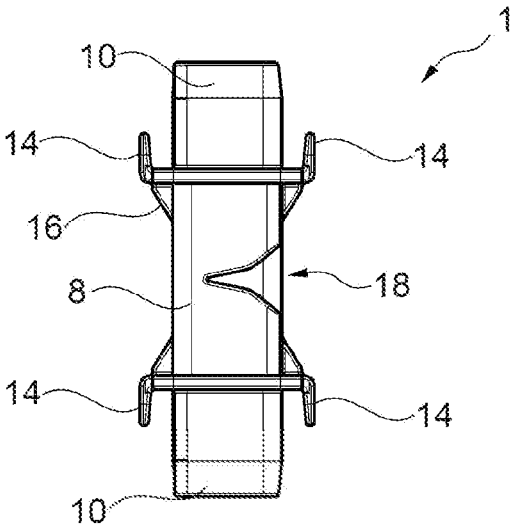
FIG. 6 shows a side view of the spacer according to the disclosure.

FIG. 6 shows a side view of the spacer 1. The fastening elements 14 protrude laterally/horizontally from the support plates 3, 5. I.e. the fastening elements 14 are not arranged within an imaginary cuboid base body. The fastening elements 14 and the plunger portions 10 both protrude vertically from the support plates 3, 5. Along an elongated axis of symmetry of the spacer 1, a portion of the connection portion 8, which is simultaneously a side wall of the spacer 1, has a slit 18. The slit 18 has a wide opening, extends in a horizontal direction and converges in the direction of extension. A beginning of a film for wrapping stacked containers 100 can be clamped in the horizontal slit 18.

Figure 7:
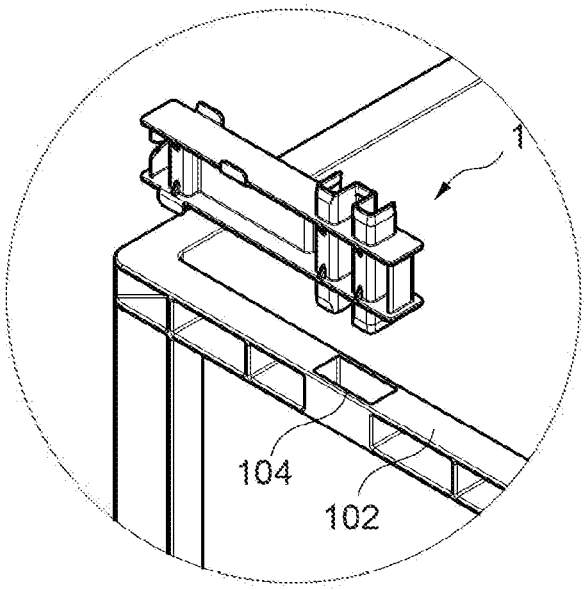
FIG. 7 shows the spacer according to the disclosure, which is placed on a container.

FIG. 7 shows a detailed view of FIG. 8 and how the spacer 1 is placed on a side wall 101 of the container 100. The container 100 is an open container with a bottom 106 and four side walls 101 projecting from the bottom 106. The container 100 also has two recesses 104 in the upper rim or side wall rim 102 on each of the two long side walls 101, which serve as automation openings and into which grippers (not shown) of an automation system for handling the container 100 in a logistics chain can engage.

The spacer 1 is placed on the upper rim or side wall rim 102 of the container 100 in such a way that one of the two plunger portions 10 is fully plunged into the recess 104 and the corresponding support surface 6 rests on the side wall rim 102 of the container 100. The plunger portions 10 are adapted to the size of the recesses 104, such that they are seated in the recesses 104 without much lateral play and define the position of the spacer 1. In addition, the fastening elements 14 enclose the side wall 101 of the container 100 from the inside and from the outside. Thus, the spacer 1 lies firmly defined on the side wall rim 102 or the container 100, respectively.

FIG. 8 shows how four spacers 1 are placed on the open container 100 in such a way that the spacers 1 each extend from the recesses 104 in the side wall rims 102 to the respective container corner or in the direction of the short side walls 101. The length of the spacers 1 essentially corresponds to the distance from the recesses 104 to the next (short) side wall 101. This ensures that the (identical) container 200 (see FIG. 10) stacked above and resting on the spacer 1 does not protrude far, or more precisely only by one side wall thickness, beyond the spacer 1, so that it is ensured that the containers 100, 200 do not tip open or over when a (vertical) force acts on the short side walls 101.

It should be noted that the spacer 1 should be positioned in such a way that the opening of the slit 18 faces outward, so that the film for wrapping the container 100 can be inserted into the slit 18 from the outside and clamped therein.

Figure 9:
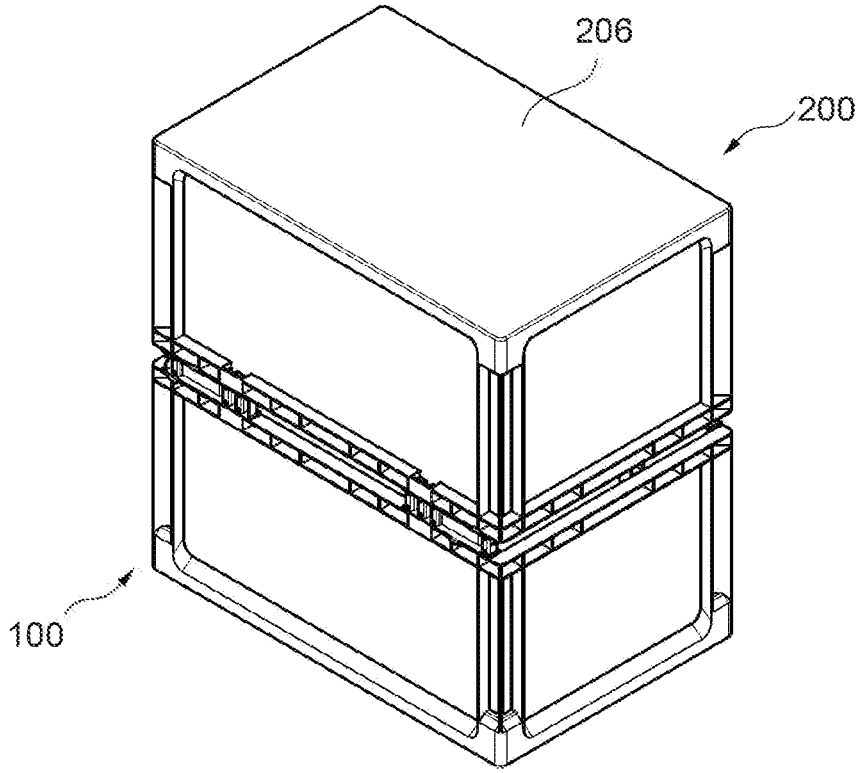
FIG. 9 shows two stacked containers with spacers according to the disclosure.

FIG. 9 shows how a further identical second container 200 is placed in reverse on the first container 100 with the spacers 1. The plunger portions 10 of the spacers 1 plunge into recesses 204 of the second container 200. The support surface 4 rests on a side wall rim 202 of the second container 200. The fastening elements 14 of the spacer 1 comprise side walls 201 of the second container 200. In this way, the second identical container 200 is stacked in a fixed position on the first container 100.

Figure 10:
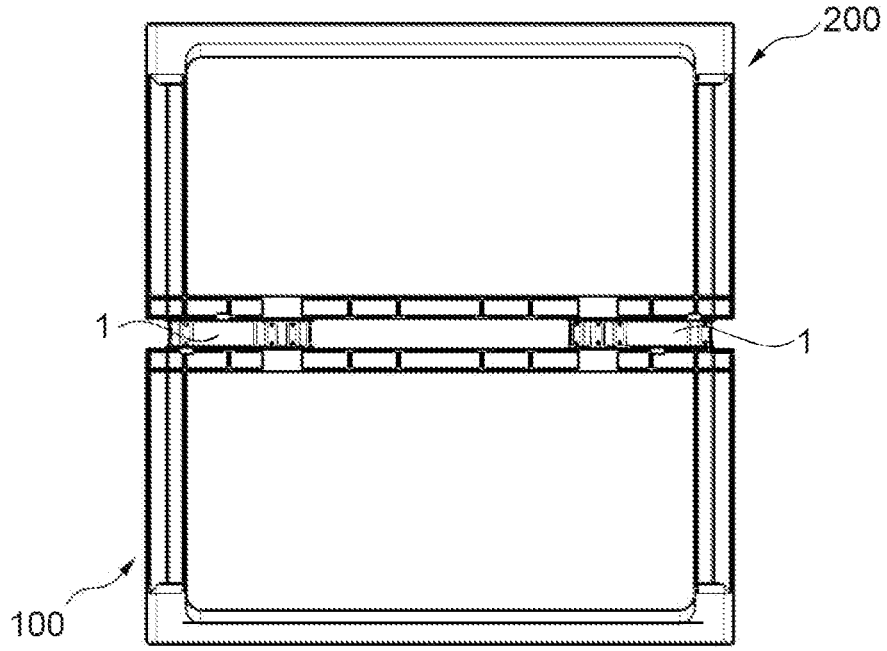
FIG. 10 shows a side view of the stacked containers of FIG. 9.

FIG. 10 shows a side view of the stacked containers 100, 200. It is clear that there is a space between the containers 100, 200 due to the spacers 1.

The invention claimed is:

1. A spacer for stacking first and second containers on each other, said spacer comprising:

a base body that is elongated, the base body comprising a first support plate having a first support surface and a second support plate having a second support surface;

at least two plunger portions projecting from the base body in opposite directions, the at least two plunger portions being configured to plunge into recesses in side wall rims of the first and second containers when the first and second containers are stacked on top of each other; and fastening elements which project from the base body in order to laterally enclose respective side walls of the first and second containers, the first and second support surfaces being configured to rest on the side wall rims of the first and second containers when the plunger portions plunge into the recesses of the first and second containers, and the first and second support plates being spaced from one another and being parallel to one another, wherein the at least two plunger portions each have a wall that meanders in a plan view.

2. The spacer according to claim 1, wherein the fastening elements project from the base body at an edge of the base body.

3. The spacer according to claim 1, wherein the fastening elements enclose a side wall of the container on both sides.

4. The spacer according to claim 1, wherein each wall spans a rectangle that is adapted to a size of one of the recesses in the side wall rims.

5. The spacer according to claim 1, wherein the first and second support plates are connected by a connection portion.

6. The spacer according to claim 5, wherein a slit is provided in the connection portion and extends transversely to a longitudinal direction of the base body or in a horizontal direction.

7. The spacer according to claim 5, wherein the connection portion is formed as a connector wall extending vertically from the first support plate to the second support plate.

8. The spacer according to claim 5, wherein the connection portion is offset at least in portions from a longitudinal axis of the first and second support plates.

9. The spacer according to claim 5, wherein the plunger portions protrude from the first support plate and from the second support plate to a side of the support plates facing away from the connection portion.

10. The spacer according to claim 5, wherein the connection portion is connected to the first support plate and the second support plate by reinforcement ribs.

11. The spacer according to claim 1, wherein the fastening elements protrude from the support plates and are arranged obliquely opposite each other.

12. The spacer according to claim 1, wherein the fastening elements and the plunger portions are arranged off-center with respect to the longitudinal extent of the base body.

13. The spacer according to claim 12, wherein the plunger portions are positioned in a different longitudinal half of the base body than the fastening elements.

14. A system comprising:

a plurality of spacers according to claim 1;

a first container; and a second container identical to the first container, the plurality of spacers comprising four plungers with plunger portions that plunge into recesses in a side wall portion of the first container and fastening elements that enclose side walls of the first container, the second container being placed inverted on the first container in such a way that plunger portions of the four plungers plunge into recesses in the second container and the fastening elements enclose side walls of the second container, so that the first container and the second container are held relative to each other and spaced apart by the spacers.

15. The system according to claim 14, wherein the base body is as wide as an upper edge of the side walls of the first and second containers.

16. The spacer according to claim 1, further comprising a connector portion comprising a connector wall that is sandwiched between the first and second support plates, wherein the first and second support plates are spaced from one another by the connector wall.

* * * * *